United States Patent [19]

Monforton et al.

[11] Patent Number: 4,786,513

[45] Date of Patent: Nov. 22, 1988

[54] PACKAGE FOR SLICED BACON ADAPTED FOR MICROWAVE COOKING

[75] Inventors: Randal J. Monforton, Phoenix; Burton R. Lundquist, Scottsdale, both of Ariz.

[73] Assignee: Conagra, Inc., Omaha, Nebr.

[21] Appl. No.: 938,532

[22] Filed: Dec. 5, 1986

[51] Int. Cl.[4] ..... B65D 81/34

[52] U.S. Cl. ..... 426/107; 426/113; 426/118; 426/115; 426/124; 426/234

[58] Field of Search ..... 426/107, 111, 118, 113, 426/234, 243, 121, 115, 124, 420

[56] References Cited

U.S. PATENT DOCUMENTS

| | | | |
|---|---|---|---|
| 1,711,372 | 4/1929 | Carter | 426/121 |
| 2,495,435 | 1/1950 | Welch | 426/234 |
| 2,509,450 | 5/1950 | Reed et al. | 426/119 |
| 2,665,993 | 1/1954 | Swanson | 426/119 |
| 2,830,910 | 4/1958 | Swanson | 426/119 |
| 3,026,209 | 3/1962 | Niblack et al. | 99/174 |
| 3,051,584 | 8/1962 | Tindall | 426/119 |
| 3,117,875 | 1/1964 | Burns et al. | 426/113 |
| 3,185,372 | 5/1965 | Ferraro | 426/107 |
| 3,361,576 | 1/1968 | Jacobson | 426/107 |
| 3,424,596 | 1/1969 | Sullivan | 426/113 |
| 3,481,746 | 12/1969 | Clemens et al. | 426/420 |
| 3,532,511 | 10/1970 | Binkerd et al. | 426/243 |
| 3,554,770 | 1/1971 | Lipsky et al. | 426/107 |
| 3,597,238 | 8/1971 | Scharre | 426/121 |
| 3,615,706 | 10/1971 | Robinson | 426/113 |
| 3,619,215 | 11/1971 | Bard et al. | 99/174 |
| 3,803,332 | 4/1974 | Seiferth et al. | 426/121 |
| 3,916,030 | 10/1975 | Bard et al. | 426/113 |
| 3,978,642 | 9/1976 | Smithers | 426/420 |
| 3,985,990 | 10/1976 | Levinson | 426/243 |
| 3,997,677 | 12/1976 | Hirsch | 426/395 |
| 4,013,798 | 3/1977 | Goltsus | 426/114 |
| 4,015,085 | 3/1977 | Woods | 426/107 |
| 4,112,833 | 9/1978 | Oda et al. | 426/243 |
| 4,141,487 | 2/1979 | Faust et al. | 229/43 |
| 4,210,674 | 7/1980 | Mitchell | 426/107 |
| 4,214,515 | 7/1980 | Kubiatowicz | 426/243 |
| 4,261,504 | 4/1981 | Cowan | 426/113 |
| 4,275,811 | 6/1981 | Miller | 206/204 |
| 4,292,332 | 9/1981 | Mehan | 426/234 |
| 4,321,997 | 3/1982 | Miller | 206/204 |
| 4,343,978 | 8/1982 | Kubiatowicz | 426/243 |
| 4,358,466 | 11/1982 | Stevenson | 426/118 |
| 4,361,227 | 11/1982 | Paulucci | 206/45.32 |
| 4,382,507 | 5/1983 | Miller | 206/204 |
| 4,390,554 | 6/1983 | Levinson | 426/113 |
| 4,390,555 | 6/1983 | Levinson | 426/234 |
| 4,404,241 | 9/1983 | Mueller et al. | 428/35 |
| 4,410,578 | 10/1983 | Miller | 428/117 |
| 4,419,373 | 12/1983 | Oppermann | 426/113 |
| 4,505,961 | 3/1985 | Lu | 428/35 |
| 4,571,337 | 2/1986 | Cage et al. | 426/107 |
| 4,590,349 | 5/1986 | Brown | 426/113 |
| 4,640,838 | 2/1987 | Isakson et al. | 426/107 |

FOREIGN PATENT DOCUMENTS

| | | | |
|---|---|---|---|
| 697240 | 9/1953 | United Kingdom | 426/415 |

OTHER PUBLICATIONS

Modern Packaging 11/53 p. 149 plus.

English Abstract Jap. Pat. Kokai 140,612/77 11/24/77.

*Primary Examiner*—Steven Weinstein

*Attorney, Agent, or Firm*—Willian Brinks Olds Hofer Gilson & Lione

[57] ABSTRACT

A package of sliced bacon is disclosed which package is adapted to facilitate the cooking of the sliced bacon by microwave energy. This package includes a plurality of bacon slices generally arranged in a stack with separating sheet means placed between otherwise adjacent bacon slices for maintaining separation of the bacon slices during storage and cooking. An absobent blotter means is included below the stack of bacon slices to absorbing liquids released from the bacon during cooking. The package also includes an overwrap means which surrounds the stack of bacon slices, the separating sheet means, and the absorbent means during storage and during cooking. In addition, a means for venting the overwrap is provided whereby expanding gases are allowed to exit the overwrap means during cooking.

16 Claims, 2 Drawing Sheets

FIG. 1
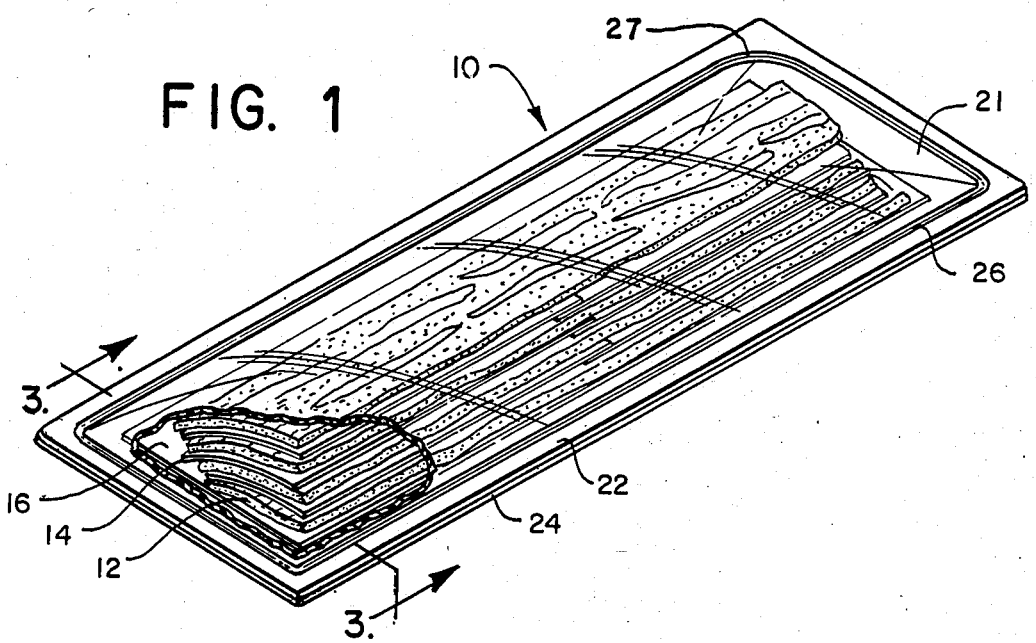
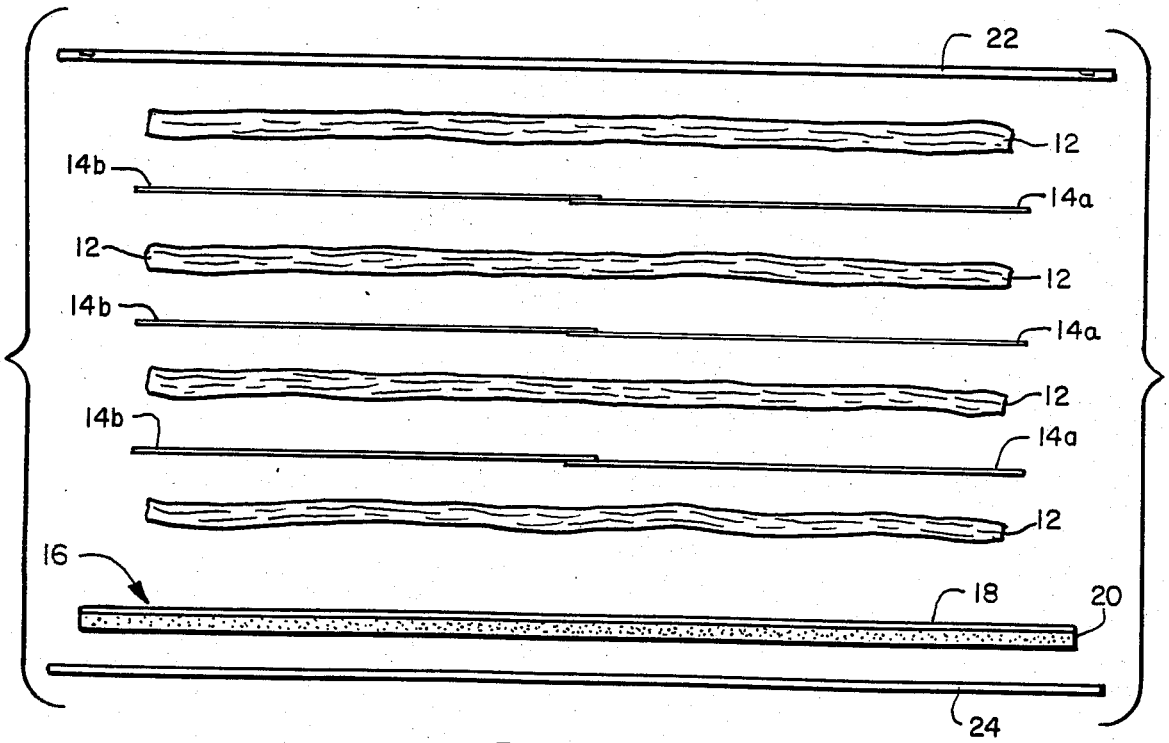
FIG. 2
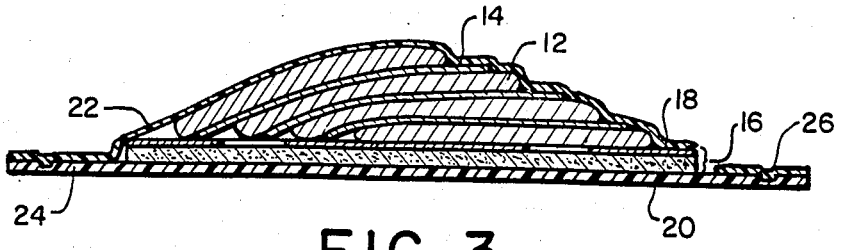
FIG. 3

FIG. 4
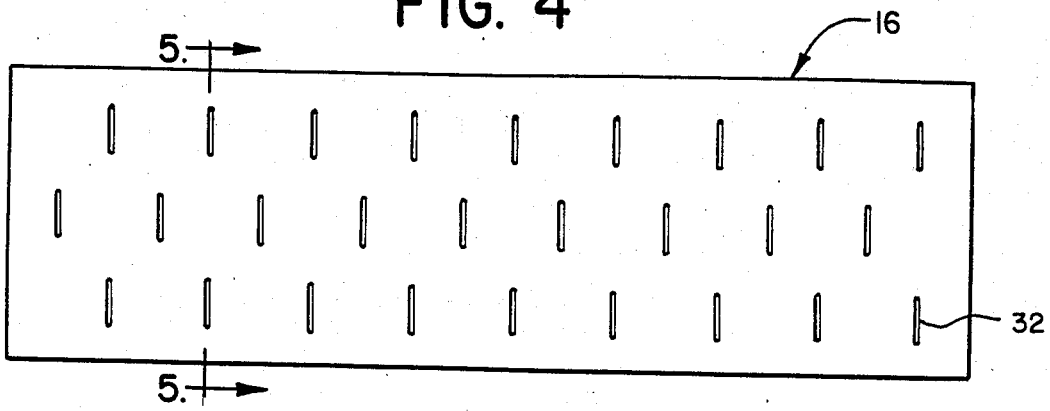
FIG. 5
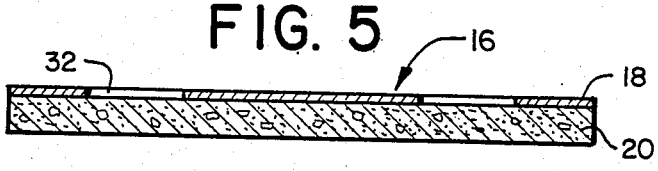
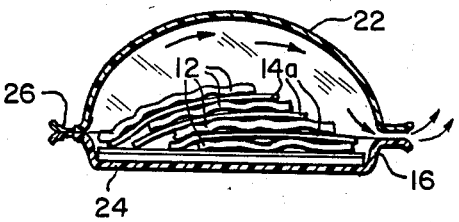
FIG. 7
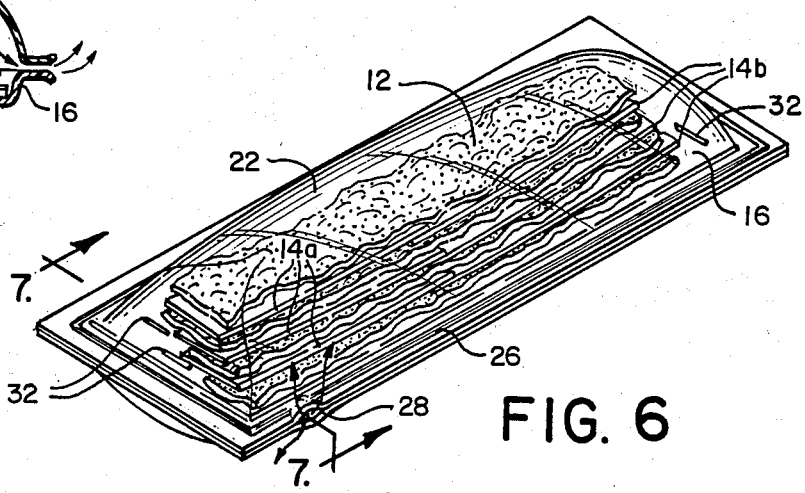
FIG. 6
FIG. 8
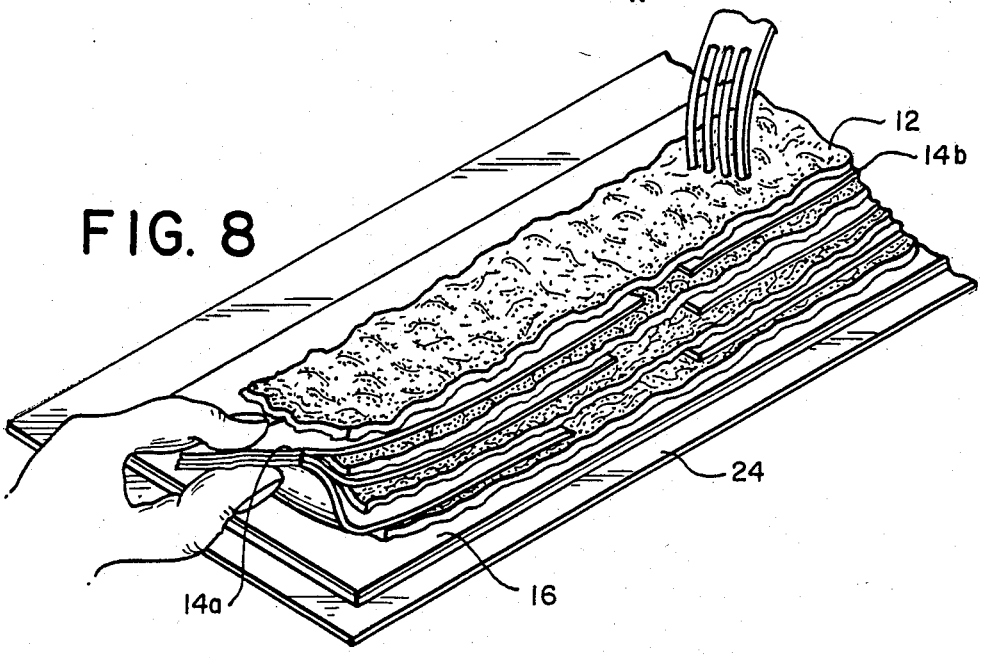

PACKAGE FOR SLICED BACON ADAPTED FOR MICROWAVE COOKING

BACKGROUND OF THE INVENTION

The Present invention relates to the field of packaging for sliced meat. More particular, the present invention relates to the field of sliced bacon packages which are adapted for microwave cooking of the bacon.

The use of microwave energy to heat and cook foods has become increasingly popular in recent years. Many consumers have acquired a microwave oven and have learned to take advantage of its speed and efficiency in preparing meals. Unfortunately however, because the mechanism of microwave cooking is different from conventional cooking, some difficulties have been encountered when cooking certain food products. Some of these difficulties have been overcome by reformulating the food products, designing special equipment to be used with the microwave oven, specifying detailed instructions for cooking particular food products, etc.

Sliced bacon is a food product for which efforts have been expended to improve its capacity to be cooked in a microwave oven. While it is a common practice to cook bacon in a microwave oven, there are certain drawbacks. In particular, most conventional packages for bacon include instructions for microwave cooking. These instructions state that each bacon slice should be separated on the plate or other container in which it is being cooked. The reason for this is to increase the uniformity of cooking from slice to slice and also to prevent the bacon slices from fusing together where lean sections come into contact.

However, when the slices are spread out, the number of slices that can be cooked at one time is limited by the area available within the cookware or the oven. In addition, because the slices are spread out over a relatively large area, it is common to observe nonuniformity of cooking from the center of the oven to the perimeter.

Also, because of its high fat content, bacon is especially messy to cook in a microwave oven. That is, most microwave cooking instructions state that the bacon should rest on and be covered by paper towels in order to reduce splattering of the grease within the oven. Naturally, this step is inconvenient and produces messy paper towels to handle and dispose of after cooking.

Another difficulty with cooking bacon in a microwave oven arises from the fact that the bacon is heterogeneous, i.e. with areas of fat and areas of lean within the same slice. Because fat and lean absorb microwave energy at different rates, it is difficult to obtain uniform cooking even within the same slice. This problem is aggravated by the fact that the bacon slices tend to curl as they are cooked. As a result, pools of melted fats and oils can accumulate on the surface of the bacon thereby causing even further nonuniformity.

Still another problem with cooking bacon in a microwave oven is caused by the fact that consumers generally have strong preferences as to the degree of crispness they seek in bacon. Thus, because the microwave oven is cooking the bacon faster and because, the bacon is usually cooked from start to finish without intervention, it is more difficult to insure that desired degree of crispness.

One effort to make bacon more convenient to cook in a microwave oven has involved the designing of special cookware. In particular, pans have been developed upon which the slices of bacon can be spread out and which facilitate draining of the grease. Naturally, this solution introduces increased cost and clean up.

U.S. Pat. No. 4,141,487 describes a package which is adapted to be used to cook a product such as bacon in a microwave oven. The bacon slices in this package are spread out in the package. The package includes an automatic venting feature.

U.S. Pat. Nos. 4,210,674 and 4,404,241 also show packages which are self-venting during microwave cooking.

U.S. Patent Nos. 3,619,215 and 3,916,030 show packages for pre-fried products such as bacon which can then be used to heat the products. In these packages the bacon is shown as being spread out.

SUMMARY OF THE INVENTION

In general, the present invention is a package of sliced bacon which package is adapted to facilitate the cooking of the sliced bacon by microwave energy. This package includes a plurality of bacon slices generally arranged in a stack. A plurality of separating sheet means are placed between otherwise adjacent bacon slices for maintaining separation of the bacon slices during storage and cooking. An absorbent blotter means is included below the stack of bacon slices to absorbing liquids released from the bacon during cooking. The package also includes an overwrap means which surrounds the stack of bacon slices, the separating sheet means, and the absorbent means during storage and during cooking. In addition, a means for venting the overwrap is provided whereby expanding gases are allowed to exit the overwrap means during cooking.

In accordance with one preferred embodiment of the present invention, the sliced bacon comprises slices of bacon which are arranged generally in a shingled stack. A sheet of silicone treated paper is placed between each slice of bacon. The absorbent blotter means includes a top layer of a thermoplastic film which is impermeable to liquids, i.e. fats, oils, and moisture, released from the bacon during storage. The top layer includes an array of holes which will let liquids pass into the absorbent layer below when they are liquified during cooking. The absorbent layer is made from molded pulp or absorbent paper. The overwrap means in this preferred embodiment is made from a top and bottom sheet of a thermoplastic film, such as polyester oven film. These sheets are sealed about their periphery. Most preferably, the venting means is provided by forming the seal between the top and bottom layers which will release when subjected to increased pressures inside the package.

As will be seen below, the package of the present invention provides a simple and convenient method for the cooking of sliced bacon in a microwave oven. For one thing, because the package of the present invention is adapted to be used as the container for the sliced bacon during cooking, there is thus no need to employ or thereafter clean a separate container. Also, because the overwrap is adapted to surround the bacon during cooking, there is thus little chance for creating a mess in the microwave oven.

It has also been found that the elements of the package cooperate to provide for a more uniform cooking of the sliced bacon in the package, i.e. more uniform from slice to slice and more uniform within each slice. Achieving cooking uniformity within each slice is particularly advantageous when cooking sliced bacon which typically cooks unevenly because of its different regions of fat and lean on each slice. The present invention is also advantageous in that it provides uniformity from package to package. That is, because the package eliminates several variables, each package should cook the bacon to the same crispness when cooked for the same time in the same oven. Thus allowing the consumer to obtain consistency not before available.

In addition, it has been found that the elements of the package of the present invention cooperate to increase the cooking efficiency. In particular, because the overwrap is effective in retaining some of the heat during cooking, the bacon slices cook faster. Also, the package is more efficient because the melted fats and oils are kept relatively close to the bacon slices, and because the melted fats and oils absorb microwave energy and thus radiate heat.

These and other advantages of the present invention will become apparent in light of the following detailed description of the preferred embodiments of the invention.

BRIEF DESCRIPTION OF THE DRAWINGS

The present invention will be more clearly understood from the following detailed description of specific embodiments, read in conjunction with the accompanying drawings, wherein:

FIG. 1 is a perspective view with a partial cut away showing the preferred embodiment of the present invention;

FIG. 2 is an exploded front side view of the embodiment shown in FIG. 1;

FIG. 3 is a cross-sectional view taken along line 3—3 of FIG. 1;

FIG. 4 is a top plan view of the absorbent blotter used in the embodiment shown in FIG. 1;

FIG. 5 is a is a cross-sectional view taken along line 5—5 of FIG. 4;

FIG. 6 is a perspective view of the embodiment shown in FIG. 1 during microwave heating;

FIG. 7 is a cross-sectional view taken along line 7—7 of FIG. 6; and FIG. 8 is a perspective view of the embodiment shown in FIG. 1 after it has been opened and showing the removal of the separating means.

DETAILED DESCRIPTION

Referring to the drawings, FIG. 1 is a perspective view of the preferred embodiment of the present invention. As shown, the package 10 includes a plurality of bacon slices 12.

While natural bacon, i.e. bacon that is sliced directly from the slab, is preferred, other bacon-like products can also be used. For example, canadian bacon is well-suited to be cooked in the package of the present invention. Also, processed bacon products, such as those wherein chopped meat and fat are extruded and then sliced, can be cooked in the package of the present invention. In addition, bacon-like products made from vegetable sources of protein and fats are also suited for use in the present package. Accordingly, the term "bacon" as used in this specification and the appended claims is intended to refer to these bacon-like products as well.

It should be noted that the term "sliced," as used in this specification and the appended claims, is intended to be interpreted broadly as referring to bacon or bacon-like products which have the general shape of slices, i.e. generally thin and flat. Accordingly, products which have been extruded or otherwise given the shape of a sliced bacon product are intended to be included within this term. In addition, products, such as bacon which is produced in circular slices are also included.

As shown in FIGS. 1 and 3, the preferred arrangement for the bacon slices 12 is to be in a stack, and most preferably in a shingled stack. By the term "stack," it is meant that the slices rest on one another with at least some overlap. Likewise, by the term "shingled," it is meant that the slices are stacked with the slices slightly offset all in the same direction. Most preferably, the offset is between about ⅛" and about 5/16". This is the form in which bacon is customarily sold. Accordingly, it is an advantage of this preferred embodiment that the bacon is packaged in a form that is familiar to most consumers. The shingled stack is also preferred for use with bacon because it is generally considered the best way to display the slices. In addition, the shingled stack is believed to be beneficial in allowing the melted fats and oils to drain from the slices during cooking.

The number of bacon slices 12 in the package 10 will depend on various factors. Packages have been tested with as few as two bacon slices (See Example 2 below) and as many as 25 (See Example 5 below). Somewhat surprisingly, the results have shown that the uniformity was obtained when cooking the 25 slices. Thus, no upper limit has been seen.

At present, it is most preferred to include four 0.75 oz. slices of bacon in each package. This number is preferred because of the flexibility it gives to the consumer. In particular, because all of the bacon in the package is cooked at once, and because most consumers would rather have their bacon freshly cooked, it is desirable to provide either the exact number of slices or a number of slices that can be multiplied to obtain the exact number of slices which will be used at one meal. That is, it is preferred to give the consumer smaller units to work with in order to achieve the total number of slices desired. In addition, in view of the great number of households consisting of one or two people, this number is preferred. In marketing the four-slice packages, it is most preferred to provide four of these packages within a single carton.

Referring again to FIG. 1 and also to FIG. 2, separating sheets 14 are placed between each slice of bacon 12. These sheets serve to maintain separation between the slices during storage and cooking. When cooking bacon by microwave energy, it has been observed that when lean sections of adjacent slices contact, they have a tendency to fuse together. Thus, the separating sheets 12 are provided to prevent this detrimental effect.

It has also been found that the separating sheets aid in draining the melted fats and oils from the bacon during cooking. In particular, the separating sheets can provide a relatively flat surface for the melted fats and oils to run down and exit the shingled stack.

In addition, the separating sheets appear to aid in achieving the uniform cooking of the bacon slices. It is believed that, because the separating sheets remain relatively flat, the melted fats and oils which drip from the slice above are relatively evenly dispersed over each of these relatively flat sheets during cooking. Thus, the sheets tends to even out the temperature seen across each slice, and also to even out the temperature seen throughout the stack.

Still another advantage discovered in using the separating sheets is the fact that the bacon slices are thereby allowed to shrink independently. In the most preferred embodiment, the separating sheets are made from 27 lb. wet strength greaseproof 2 side silicone treated parchment paper. Such paper can be obtained from the Westcarlton Company under the designation "silicone paper." Other materials are also available for the separating sheets. For example, a 50 ga. polyester ovenable film is suitable.

Preferably, the separating sheets are sized so as to be approximately equal in width to the bacon slices and so as to extend slightly beyond the length of the bacon slice. In the most preferred embodiment, each paper 14 extends about ¼" beyond the end of each bacon slice.

In some embodiments, it may be desirable to use separating sheets which are transparent or translucent so as not to detract from the appearance of the sliced bacon product.

As shown in FIG. 2, there are actually two separating sheets between each bacon slice in the most preferred embodiment. These two sheets 14*a* and 14*b* meet near the center of the bacon slice, most preferably with a slight overlap. Alternatively, this can be viewed as using one sheet that has been split in the middle. The reason for using split separating sheets is that it has been found to make removal of the sheets after cooking an easier task. As shown in FIG. 8, the split sheets can be removed by pulling the sheets from one side of the stack while pressing down on the other side and repeating the process for the other side. As shown, this is facilitated by the fact that, because the bacon has shrunk, the separating sheets extend even further from the edge of the bacon. This feature of easy removal is important because at this time, the separating sheets and the slices are covered with the melted fats and oils released from the bacon product during cooking. In addition, with this method of removal, the shingled stack of bacon is left intact for serving.

As an alternative to using individual sheets between each bacon slice, it may be desired to use a single sheet which is folded in zigzag fashion whereupon the slices of bacon can be laid between alternating folds.

Referring to FIGS. 1, 2, and 3, an absorbent blotter means 16 is provided below the shingled stack of bacon slices 12. As the name implies, this blotter 16 functions to absorb the liquids, i.e. melted fats, oils, and moisture, that are released from the slices during cooking. This is preferably accomplished by incorporating into the blotter a material, such as a paper pulp product, which material will absorb, i.e. on a microscopic scale, the liquids being released.

Alternatively, the blotter means may employ a cavity or series of cavities into which the liquids can drain during cooking. In this case, the blotter itself is viewed as absorbing the liquids on a macroscopic scale. In such an alternative embodiment it is certainly desirable that the cavity or cavities in the blotter be configured so as to avoid the chance of the consumer spilling the hot fats and oils when handling the package after cooking. Also, because the melted fats and oils are useful as a heat source during cooking, the use of an absorbent material in the blotter, whereby the fats and oils are evenly dispersed in the blotter, is currently preferred.

Generally, it is required to maintain a constant weight of the bacon product during storage. In other words, if the net weight of the bacon product at the time of packaging is 4 oz. and it is sold as 4 oz., that weight should be 4 oz. at the time of cooking. Accordingly, it is preferable that the blotter 16 not absorb any fats, oils, or moisture from the bacon product during storage, i.e. until cooking.

This result can be accomplished by including a layer 18 of a material which is impermeable to fats, oils, and moisture on top of a layer 20 of a material which will absorb fats and oils. As shown in FIGS. 4 and 5, an array of holes 32 passing through the top layer 18 are provided to allow the liquids released from the bacon product, to pass into the absorbent layer 20. The size, number, and arrangement of the holes 32 should be selected so as to minimize any premature absorption of liquids released from the bacon product while providing for a suitable absorption rate for the blotter 16.

The most preferred method of delaying absorption of fats and oils by the blotter while yet providing for a sufficiently fast absorption by the blotter during is described and claimed in the U.S. patent application by the same inventors, filed on the same day as the present application, and assigned to the same assignee which application has issued as U.S. Pat. No. 4,720,410 on Jan. 9, 1988. This application, which is incorporated herein by reference, describes a blotter means which includes a top layer of a heat shrinkable film such as polyester. The film includes an array of slits or perforations. The film is adhered to the lower layer only at limited areas between the slits or perforations. As a result, when the blotter is heated, the top film shrinks and thus relatively large holes are automatically formed through its surface.

In this most preferred embodiment, the heat shrinkable film is a 0.0005" thick polyester film sold by DuPont under the designation "H.S. Mylar." This particular polyester film is preferred because of its stability at the temperatures encountered during cooking. In other words, the film will shrink at the temperatures at cooking yet will not melt or otherwise degrade at these temperatures. An array of eighteen ⅞" slits are cut into this film which are on 1½" centers along the length of the film and 1" centers along the width of the film. Adhesive is applied to the board in 5/16" strips in a checked pattern between the slits. Tests have shown that when this board is heated the resultant holes are oval in shape with a length of about ½" and a width of about 5/16".

The absorbent layer 20 of the blotter 16 is made from a material which will absorb the melted fats, oils, and any moisture released from the bacon product during cooking. Preferably, this layer is made from molded paper pulp. This material is preferred because of its high absorption per weight. For example, the molded paper pulp board of the most preferred embodiment can absorb between about 1 and about 5 oz. of liquids for each oz. of the board's weight. Alternatively, the absorbent layer can be made from another absorbent paper product such as that used in paper towels or corrugated cardboard.

In the most preferred embodiment the blotter 16 is generally planar and sized so as to extend about 0.5" beyond each edge of the shingled stack. This extension is desirable in order to catch most of the liquids draining from the bacon. In alternative embodiments, the blotter is made with a lip around its periphery in order to better catch and retain the draining liquids.

The blotter may also include a bottom layer of a material which is impermeable to the liquids released from the bacon product. As such, the blotter would thus retain all of these liquids and not let them pass through its bottom. However, because the blotter sits on top of the overwrap which will be impermeable to the fats and oils from the bacon slices, this bottom layer for the blotter is not considered necessary.

The package of the invention further comprises an overwrap 21 which surrounds the stack of bacon slices 12, the separating sheets 14, and the absorbent blotter 16. This overwrap is made from a material which is substantially gas impermeable in order for it to properly isolate the bacon slices from the environment during storage. Preferably, the overwrap comprises a top sheet 22 of a polymer film and a bottom sheet 24 of a polymer film which sheets have been sealed to each other about their periphery by a seal 26. Preferably, the seal 26 is spaced about ¼" from the edges of the blotter 16. Also, the top sheet 22 is preferably transparent so as to allow inspection of the bacon slices by the consumer.

The overwrap used in the most preferred embodiment is a 3 mil fully coextruded nylon/ethylvinyl acetate/surlyn peelable blend film for the top and bottom sheets. Such a film can be obtained from the American Can Company under the designation "E-Z Peel" film. Alternatively, the top and bottom sheets are made from a 3 mil biaxially oriented nylon/saran/surlyn sealant film with a low temperature coating.

In accordance with accepted bacon packaging technology, the final seal between the top and bottom sheets of the overwrap is formed in a reduced atmosphere so that substantially all of the air is removed from the package during storage, i.e. the bacon is "vacuum packed". Alternatively, the overwrap can be applied in an inert atmosphere, such as nitrogen or carbon dioxide.

It is important that the overwrap 21 includes some means for venting itself so that it can release the expanding gases and steam from within the package during cooking. In the simplest embodiment, this venting means is provided by using a piercable film for the overwrap coupled with instructions to the consumer to so pierce the overwrap before cooking. Similarly, the overwrap can comprise a hole which is covered by a tape or the like which the consumer can simply remove before cooking.

However, in an effort to make the package as convenient as possible and also to prevent a mishap through the misuse by a careless consumer, it is preferred that the venting means of the package operate automatically, i.e. in response to cooking. This result can be accomplished by using a seal between the top and bottom sheets of the overwrap which will release in response to increased pressure within the package. One such releasable seal is generally known in the art as an EZ-peel seal. The EZ-peel seal has been used for other packages to facilitate opening the package by the consumer by pulling apart two films joined by an EZ-peel seal. It has been discovered that the EZ-peel seal can be used in the present invention to accomplish automatic venting of the overwrap. That is, the EZ-peel seal will release in response to the increased pressure in the package during cooking.

Another important advantage of using an EZ-peel seal between the top and bottom sheets of the overwrap is that it thus allows for easy opening of the overwrap by the consumer after cooking. That is, after cooking, the consumer can simply pull the top sheet off to expose the cooked bacon slices.

In the most preferred embodiment this EZ-peel seal is made by using one of the overwrap films mentioned above and forming a thermal seal between the top and bottom sheets. Because of the nature of the layers in the films referred to, a seal is created which will release when sufficient forces pull the top and bottom sheets apart. To facilitate this opening, the seal 26 between the top and bottom sheets is formed with a bevelled corner 27 which results in a larger area beyond the seal which provides for easier gripping by the consumer.

FIGS. 6 and 7 show the package during cooking. As stated, in response to the increased pressure within the package, the seal 26 will release and create at least one venting hole 28 to allow gases and steam to escape the package. The size of the venting hole 28 will depend on the pressure within the package and the force needed to separate the seal 26. Typically the size of the hole will be limited by these two factors so that the pressure inside the package will remain higher than the ambient pressure. As a result, the package will take on the pillow shape shown in FIG. 6 and 7. This result is thought to be increase the efficiency of cooking with this package in that the overwrap thus acts as a dome to maintain the heat generated by the interaction of the microwaves with the bacon slices within the package.

Leaving the overwrap around the bacon slices is also beneficial in that the fats and oils released by the slices are thus completely contained within the microwave oven during cooking.

The efficiency of the package of the preferred embodiment is also benefitted by the fact that the melted fats and oils absorbed in the blotter continue to absorb microwave energy and to thereby radiate heat. As a result, the blotter itself acts as a heat source to aid in cooking the bacon.

EXAMPLES

The following examples are provided by way of explanation of various embodiments of the present invention and as such should not be seen as limiting in any way the scope of this invention.

In Example 1, four slices of bacon were used. These slices each weighed approximately ¾ oz. and were approximately 3/32" thick, 1" wide and 8.5" long. In particular, these bacon slices are identical to those sold by ARMOUR FOOD COMPANIES under the designation Armour Star Pan Size Bacon—12 oz. The separating sheets used in this example were the silicone treated papers referred to above. The blotter used in this example was not made in accordance with the preferred embodiment, but was constructed of materials available to the inventors at the time of testing. The blotter was made from a 3" by 9" piece of C-flute corrugated 250 pound cardboard. A like-sized sheet of 10 point poly-coated paperboard was adhered to the top of this board. An 18 by 6 array of 1/16" holes was punched through the poly-coated paperboard and the C-flute cardboard. Finally, 10 grams of paper towels, i.e. "Shur-wipe" wipers from Fort Howard Paper Co., were placed below the C-flute cardboard. The overwrap used was that described above, i.e. the E-Z Peel film sealed with a thermal seal about ¼" from the edges of the blotter.

This package was placed in a typical microwave oven sold for home use, i.e. an oven sold by Quasar under the designation "Insta-Matic TM" with variable power. The power was set at medium (M), i.e. 490 watts, and the bacon was cooked for 4 minutes. After cooking, the bacon was evaluated as described below in connection with Table 1.

Example 2 was performed the same as Example 1 except that only two slices of bacon were included in the package. In addition, the blotter did not include the paper towels below the C-flute cardboard. This package was cooked as in Example 1 and the evaluation of the bacon cooked in this package as well as the packages of all the other examples is shown in Table 1.

Example 3 was performed the same as Example 1 except that 6 slices of bacon were included in the package. In addition, the package was cooked on the medium high setting (MH), i.e. 650 watts, for 4.5 minutes (45 seconds per slice).

Example 4 was performed the same as Example 3 except that 10 slices of bacon were included in the package. The package was cooked for 7.5 minutes on medium high.

stack such that the slices could not be practically separated. Next, the crispness of each of the slices was noted on a scale of 1 to 10, with 1 denoting raw and 10 denoting very crisp but not burnt. Each slice was identified by number with number 1 being the slice on top of the stack and the largest number being on the bottom of the stack, next to the blotter. Finally, each stack of bacon was given a consistency rating. This rating was based on the consistency of cooking from slice to slice as well as the consistency of cooking within each of the slices. The rating was made on a 1 to 10 scale with 10 being the highest consistency.

These observations are collected in the table below.

TABLE

| Example No. | 1 | 2 | 3 | 4 | 5 | 6 | 7 | 8 | 9 | 10 | 11 |
|---|---|---|---|---|---|---|---|---|---|---|---|
| No. slices | 4 | 2 | 6 | 10 | 25 | 4 | 4 | 4 | 4 | 4 | 4 |
| Sil. paper | x | x | x | x | x | x | x | x | — | x | — |
| Cardboard | x | x | x | x | x | x | x | — | x | — | — |
| Paper Towels | x | x | x | x | x | x | — | x | x | — | — |
| Cooking Time | 4 | 2 | 4.5 | 7.5 | 19 | 3 | 4 | 4 | 4 | 4 | 4 |
| Temperature | M | M | MH | MH | MH | H | M | M | M | M | M |
| Stick Factor | 1 | 1 | 1 | 1 | 1 | 1 | 1 | 1 | 5 | 2 | 5 |
| Consistency | 8 | 9 | 9 | 9 | 8.5 | 9 | 7 | 8 | ** | 6 | ** |
| Crisp | | | | | | | | | | | |
| #1 | 8 | 7 | 10 | 10 | 9 | 7 | 8 | 9 | 7 | 6 | 4 |
| #2 | 7 | 7 | 9 | 9 | 9 | 7 | 6 | 8 | — | 5 | — |
| #3 | 7 | | 9 | 9 | 9 | 7 | 6 | 7 | — | 5 | — |
| #4 | 8 | | 9 | 9 | 9 | 7 | 7 | 7 | — | 4 | — |
| #5 | | | 9 | 9 | 9 | | | | | | |
| #6 | | | 9 | 9 | 9 | | | | | | |
| #7 | | | | 9 | 10 | | | | | | |
| #8 | | | | 9 | 10 | | | | | | |
| #9 | | | | 9 | 10 | | | | | | |
| #10 | | | | 9 | 10* | | | | | | |

*Slices 11–25 of Example 5 each had a crispness rating of 10.
**The slices were fused together so that the consistency and crispness could not be measured for Examples 9 and 11.

Example 5 was performed the same as Example 3 except that 25 slices of bacon were included in the package. The package was cooked for about 19 minutes on medium high.

Example 6 was performed the same as Example 1 except that the package was cooked for 3 minutes on the high setting (H), i.e. 700 watts.

Example 7 was performed the same as Example 1 except that the blotter did not include the paper towels below the C-flute corrugated cardboard.

Example 8 was performed the same as Example 1 except that the blotter did not include the C-flute corrugated cardboard.

Example 9 was performed the same as Example 1 except that no silicone papers were placed between the slices of bacon. After cooking on the medium setting for 4 minutes, the four slices were fused together.

Example 10 was performed the same as Example 1 except that the package did not include a blotter below the slice of bacon. That is, the packae consisted of four shingled slices of bacon with silicon papers between and covered by the described overwrap.

Example 11 was performed the same as Example 10 except that no silicone papers were placed between the slices of bacon. That is, the package consisted of four shingled slices of bacon in the described overwrap. After cooking on the medium setting for 4 minutes, the slices of bacon were fused together.

After cooking for the prescribed time and then cooling for 1 to 3 minutes, each of the packages was opened and the bacon analyzed in the following way. First, the stick factor of the stack of bacon was observed and noted. In particular, the stack was rated on a 1 to 5 scale with 1 denoting no stick and 5 denoting a fusion of the It is thus seen that the present invention provides a convenient and efficient package for microwave cooking of sliced bacon. Although much of the discussion herein has involved a package for natural sliced bacon, it should be noted that other sliced meats, such as canadian bacon and processed bacon, and meat-like products, such as imitation bacon made from vegetable protein, are also contemplated for use in the present invention. Also, although much of the discussion has involved using a blotter which comprises an absorbent material, a blotter which includes a cavity or series of cavities into which the liquids can drain during cooking is also within the present invention. Certainly, these and other modifications which are within the ordinary skill in the art to make are considered to lie within the scope of the invention as defined by the following claims.

We claim:

1. A package of sliced bacon which is adapted to facilitate the cooking of the sliced bacon by microwave energy, which package comprises:

a plurality of bacon slices generally arranged in a stack;

separating sheet means lying between otherwise adjacent bacon slices for maintaining separation of each of the bacon slices from each other during said microwave cooking and for effecting more uniform cooking of the bacon slices and for effecting drainage of the liquids released from the bacon during cooking;

an absorbent blotter means below the stack of bacon slices for absorbing liquids released from the bacon during cooking, said absorbent means further functioning as a heat source, as the absorbed liquids radiate heat, to thereby contribute to the cooking of the bacon slices;

overwrap means for surrounding the stack of bacon slices, the separating sheet means, and the absorbent means during storage and during cooking; and vent means for venting said overwrap means such that expanding gases are allowed to exit said overwrap means during cooking wherein said package is sufficiently microwave transparent to allow for microwave cooking of the bacon slices therein.

2. The package of claim 1 wherein the overwrap means comprises a top sheet and a bottom sheet of a polymer film which top and bottom sheet are joined by a seal to each other around their periphery.

3. The package of claim 2 wherein said vent means comprises forming said seal so as to be adapted to at least partially release in response to increased pressure caused by expanding gases during cooking of the package, whereby said overwrap means is automatically vented during cooking.

4. The package of claim 1 wherein said absorbent means comprises a top layer made of a material which is substantially impermeable to fats and oils from the bacon slices, and at least one absorbent layer below the top layer which absorbent layer is comprised of a material which will absorb fats and oils released from the bacon slices, and wherein said top layer includes an array of holes for allowing fats and oils from the bacon slices to pass into the lower layer when liquified during cooking.

5. The package of claim 4 wherein said absorbent blotter means further comprises a bottom layer which is substantially impermeable to the fats and oils released from the bacon slices whereby said fats and oils are retained within said absorbent layer.

6. The package of claim 1 wherein the bacon slices are natural slices of bacon.

7. The package of claim 1 wherein the bacon slices are slices of canadian bacon.

8. The package of claim 1 wherein the separating sheet means comprise sheets of paper which are treated to be resistant to heat and fats and oils from the bacon slices.

9. The package of claim 8 wherein the paper is silicone treated paper.

10. The package of claim 8 or 9 wherein two separating sheets are placed between each slice of bacon so as to meet at a point intermediate the ends of the slices of bacon to facilitate removal of said sheets from between the bacon slices whereby separating sheets in a first side of the stack can be removed while pressing down on the other side of the stack, and the sheets on the other side of the stack can be removed while pressing down on the first side of the stack.

11. A package of sliced bacon which is adapted to facilitate cooking of the sliced bacon by microwave energy, the package comprising:

a plurality of bacon slices arranged generally in a shingled stack;

a plurality of separating sheets located between otherwise adjacent bacon slices for maintaining separation of each of the bacon slices from each other during said microwave cooking and for effecting more uniform cooking of the bacon slices and for effecting drainage of the liquids released from the bacon during cooking;

an absorbent blotter means located below the stack of bacon slices for absorbing fats and oils released from the bacon slices during cooking, said absorbent means further functioning as a heat source, as the absorbed liquids radiate heat, to thereby contribute to the cooking of the bacon slices, said absorbent means comprising a top layer made of a material which is substantially impermeable to fats and oils from the bacon slices, and at least one absorbent layer below the top layer which absorbent layer is comprised of a material which will absorb fats and oils released from the bacon slices, and wherein said top layer includes means for allowing fats and oils from the bacon slice to pass into the lower layer when liquified during cooking;

overwrap means for surrounding the stack of bacon slices, the separating sheet means, and the absorbent means during storage and during cooking, said overwrap means comprising a top and a bottom sheet of polymer film which top and bottom sheet are joined by a seal to each other around their periphery; and vent means for venting said overwrap means such that expanding gases are allowed to exit said overwrap means during cooking wherein said package is sufficiently microwave transparent to allow for microwave cooking of the bacon slices therein.

12. The package of claim 11 wherein said vent means comprises forming said seal so as to be adapted to at least partially release in response to increased pressure caused by expanding gases during cooking of the package, whereby said overwrap means is automatically vented during cooking.

13. The package of claim 11 or 12 wherein two separating sheets are placed between each slice of bacon so as to meet at a point intermediate the ends of the slices of bacon to facilitate removal of said sheets from between the bacon slices whereby separating sheets in a first side of the stack can be removed while pressing down on the other side of the stack, and the sheets on the other side of the stack can be removed while pressing down on the first side of the stack.

14. The package of claim 11 wherein said means for allowing said fats and oils to pass includes an array of holes for allowing fats and oils from the bacon slice to pass into the lower layer when liquified during cooking.

15. The package of claim 11 wherein the separating sheets are sheets of silicone treated paper.

16. The package of claim 11 wherein a pair of separating sheets is placed between otherwise adjacent bacon slices and wherein each sheet of said pair of sheets is sized and arranged so that each sheet of pair meets at a point intermediate the two ends of the bacon slices and each sheet of said pair of sheets extending to opposite ends of the bacon slices.

* * * * *